US009113757B2

(12) United States Patent
Desai

(10) Patent No.: US 9,113,757 B2
(45) Date of Patent: Aug. 25, 2015

(54) TOILET AND SUPPORT BARS FOR THE DISABLED

(71) Applicant: Kishor C. Desai, Winter Park, FL (US)

(72) Inventor: Kishor C. Desai, Winter Park, FL (US)

( * ) Notice: Subject to any disclaimer, the term of this patent is extended or adjusted under 35 U.S.C. 154(b) by 324 days.

(21) Appl. No.: 13/919,870

(22) Filed: Jun. 17, 2013

(65) Prior Publication Data

US 2013/0276221 A1 Oct. 24, 2013

Related U.S. Application Data

(63) Continuation-in-part of application No. 13/609,189, filed on Sep. 10, 2012, now Pat. No. 8,484,770, and a continuation-in-part of application No. 12/586,951, filed on Sep. 30, 2009, now abandoned.

(51) Int. Cl.
*E03D 11/00* (2006.01)
*A47K 17/02* (2006.01)

(52) U.S. Cl.
CPC ..... *A47K 17/022* (2013.01)

(58) Field of Classification Search
CPC .... A47K 17/026; A47K 17/022; A47K 17/02
USPC ..... 4/420, 254, 667, 480
See application file for complete search history.

(56) References Cited

U.S. PATENT DOCUMENTS

| | | | | |
|---|---|---|---|---|
| 3,398,410 A | | 8/1968 | Sparling | |
| 4,012,797 A | | 3/1977 | Kristoffersen | |
| 4,894,871 A | * | 1/1990 | Schmerler | 4/254 |
| 4,924,531 A | * | 5/1990 | Square | 4/667 |
| 5,329,645 A | | 7/1994 | Fossum et al. | |
| 6,571,399 B1 | * | 6/2003 | Wagener | 4/301 |
| 6,983,493 B1 | * | 1/2006 | Shaumyan | 4/254 |
| 8,484,770 B2 | * | 7/2013 | Desai | 4/420 |
| 2010/0031429 A1 | | 2/2010 | Kim et al. | |
| 2011/0072569 A1 | | 3/2011 | Desai | |
| 2012/0030868 A1 | | 2/2012 | Hall | |
| 2012/0246813 A1 | | 10/2012 | Manning | |

FOREIGN PATENT DOCUMENTS

| | | |
|---|---|---|
| GB | 2 446 569 A | 8/2008 |
| JP | 2002-102119 | 4/2002 |

OTHER PUBLICATIONS

"Straddle Stainless Steel Grab Bar—30"," Ocelco website; http://www.ocelco.com/store/pc/Straddle-Stainless-Steel-Grab-Bar-30-689p3340.htm.

* cited by examiner

*Primary Examiner* — Huyen Le
(74) *Attorney, Agent, or Firm* — Richard C Litman

(57) ABSTRACT

The toilet and support bars for the disabled has a toilet bowl and toilet seat configured to face the toilet tank, thereby enabling disabled and physically debilitated persons to move forward to sit on the toilet seat. The toilet has a pedestal on which the tank is mounted, and an inverted U-shaped support bar having legs supported by the building structure, to provide stability for the disabled person to use the toilet. The support bar includes a crossbar handle above the level of the tank that a disabled person may grasp for assistance in moving forward onto the toilet seat and rearward off the toilet seat. The handle may have a resilient grip. The support bar may also include stabilizers for maintaining the support bar in a rigid and fixed position so that the user is assured to find the necessary support.

15 Claims, 6 Drawing Sheets

TOILET AND SUPPORT BARS FOR THE DISABLED

CROSS-REFERENCE TO RELATED APPLICATIONS

This application is a continuation-in-part of my prior U.S. nonprovisional patent application Ser. No. 13/609,189, filed Sep. 10, 2012, now pending, which is a continuation-in-part of my prior U.S. nonprovisional patent application Ser. No. 12/586,951, filed Sep. 30, 2009, now abandoned, which are hereby incorporated by reference in their entirety.

BACKGROUND OF THE INVENTION

1. Field of the Invention

The present invention relates to plumbing fixtures, and particularly to a toilet and support bars for the disabled that are specifically designed for handicapped persons, as well as anyone having difficulty using a conventional toilet fixture.

2. Description of the Related Art

Conventional toilets are all arranged with the broader part of the seat (the part on which the user sits/places their buttocks) positioned at the rear, meaning nearest to the cistern/flushing tank, and the seat narrows towards the front. This is true for all toilets, whether close-coupled or not, and whether for the able-bodied or for the physically or mentally disabled. In toilets designed for the disabled, a handlebar may be provided to assist them in moving to and from the toilet, but this is normally positioned extending in a plane parallel to the front-rear axis of the toilet, either at the right- and/or left-hand side of the toilet.

For those with physical or mental disabilities, such as Muscular Dystrophy, Alzheimer's, spinal injuries or amputees, they generally have no choice but to use these conventional toilets, since there are no options available to them. They are, however, far from ideal for the disabled. A major problem with conventional toilet design is that when a wheelchair-bound disabled person wants to use the toilet, it is difficult for him/her to get off the wheelchair to make the transfer onto the toilet. The wheelchair user must turn 180° and maneuver onto the toilet seat.

Even for those who provide care for wheelchair users, it is hard for the caregiver to get the wheelchair user off of the wheelchair, carry them to the toilet, turn them around, and put them on the toilet seat. It is a cumbersome process, and a back-breaking job for the caregiver.

Thus, a toilet for the disabled solving the aforementioned problems is desired.

SUMMARY OF THE INVENTION

The toilet and support bars for the disabled includes a toilet bowl, a toilet seat, and a toilet bowl lid having a design configuration for reversed western toilet seating. In this manner, a user can access the toilet seat easily from a wheelchair by shifting forward from the wheelchair onto the toilet, and can easily move from the toilet to the wheelchair. A toilet tank or cistern coupled to the toilet bowl maintains a reservoir of water. Typically, a flush handle is disposed on either side of the tank or cistern, allowing the user to reach the flush handle with little effort. The tank or cistern sits atop a pedestal, which is anchored to the floor or other supporting structure. The toilet bowl communicates with the tank via the pedestal so that the flush water travels from the tank through the pedestal to the bowl, and finally through a drain to dispose of waste after use.

The toilet and support bars also have a support handlebar attached to the adjacent building structure (i.e., floor, walls). The support handlebar has a substantially inverted U-shaped member made from a rigid material. The legs of the inverted U-shaped member are attached to anchors, and extend vertically between the toilet tank and the toilet bowl. The top of the support handlebar provides a handle that extends horizontally between the legs across the width of the toilet. The handle may be covered with a resilient material for comfort. In use, the handle allows the user to maintain stability, balance, and coordination while using the toilet. The resilient material is formed of a substance resistant to microbes, bacteria, and other microorganisms, thus reducing the risk of spreading disease and infections to different users. In addition, the handle bar in accompanied with additional stabilizer bars, symmetrically disposed about the support handlebar for maintaining the handlebar in a fixed and rigid position.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
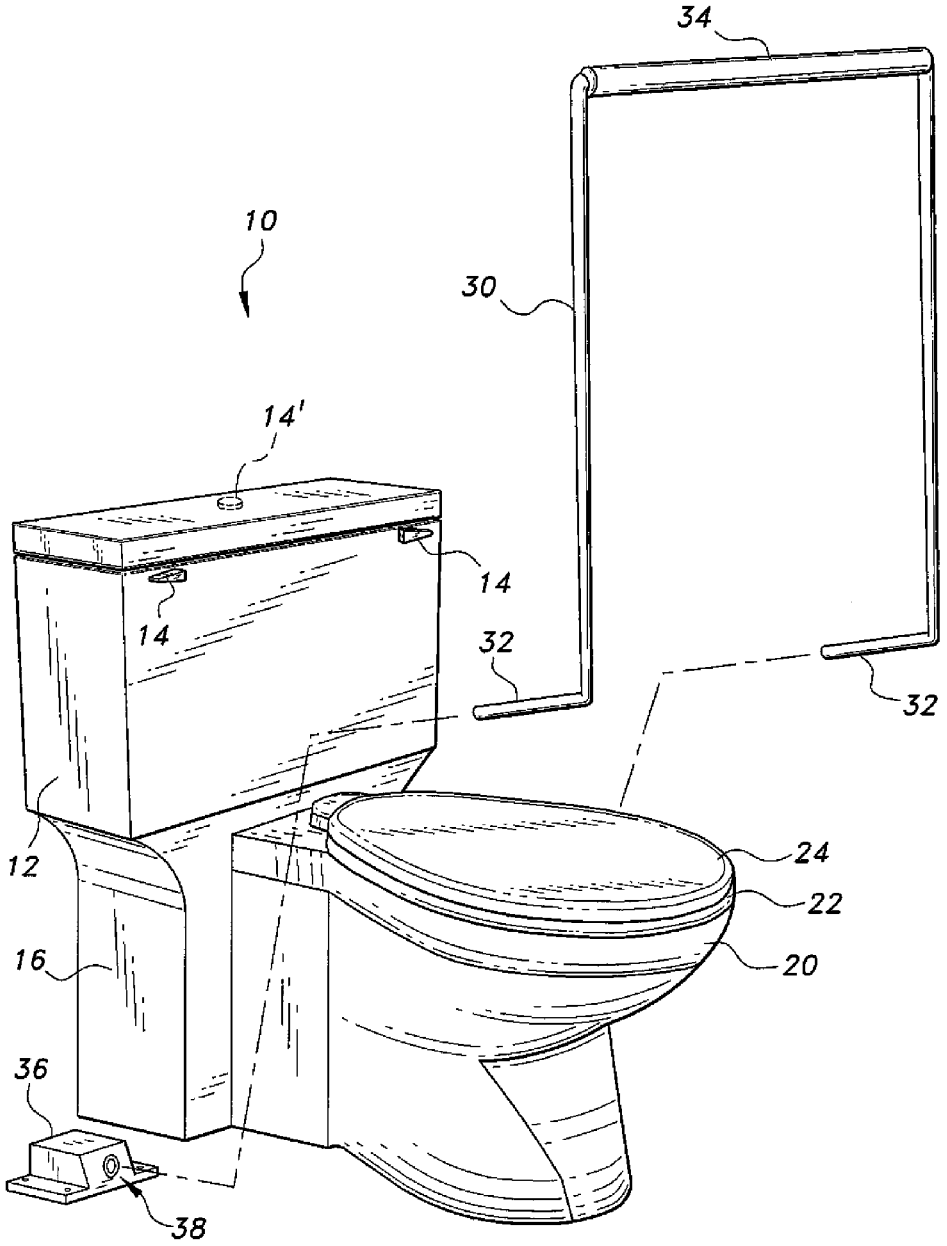
FIG. 1 is a partially exploded perspective view of the toilet and support bar of a first embodiment.
Figure 2:
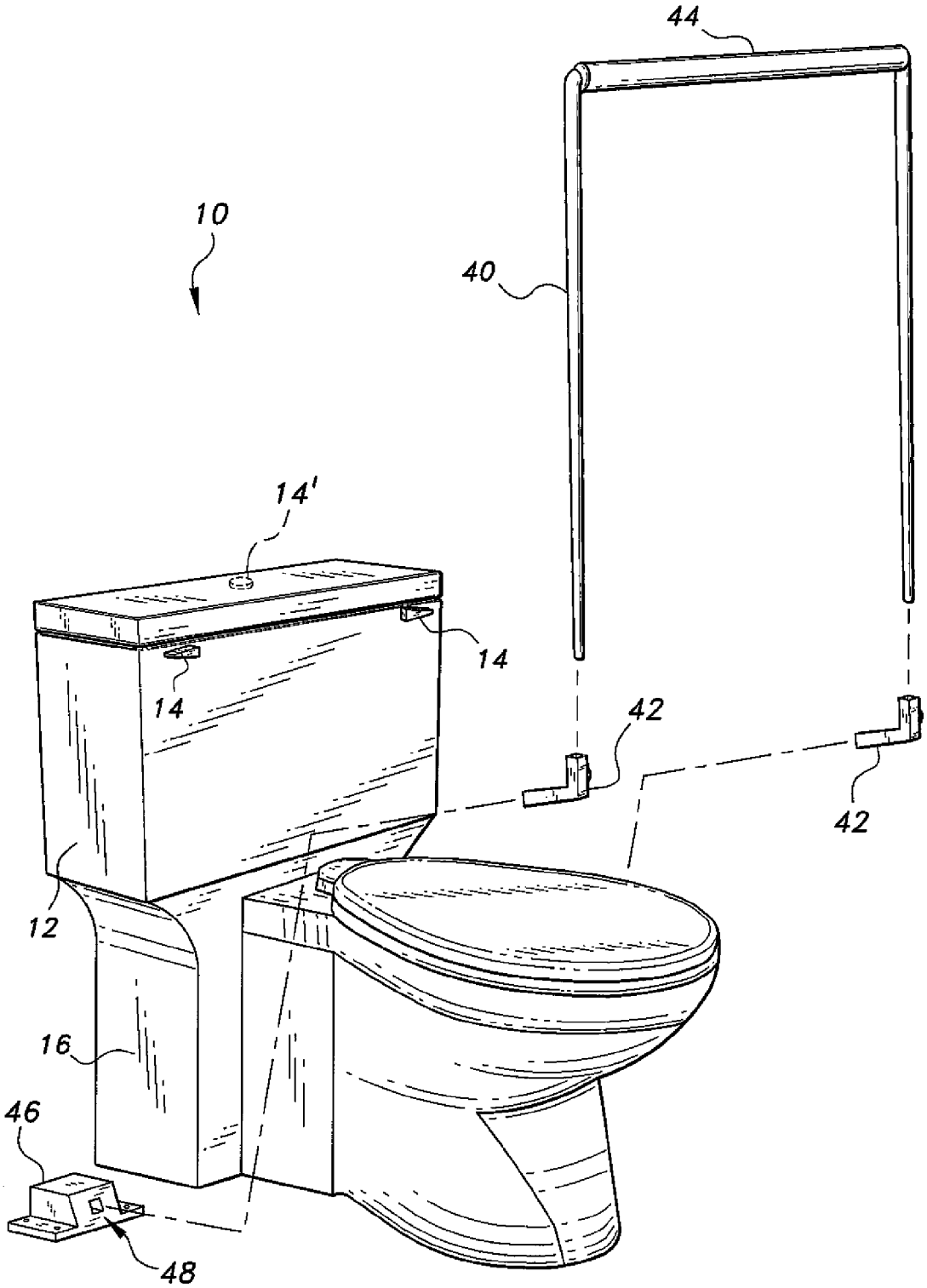
FIG. 2 is a partially exploded perspective view of the toilet and support bar of a second embodiment.
Figure 3:
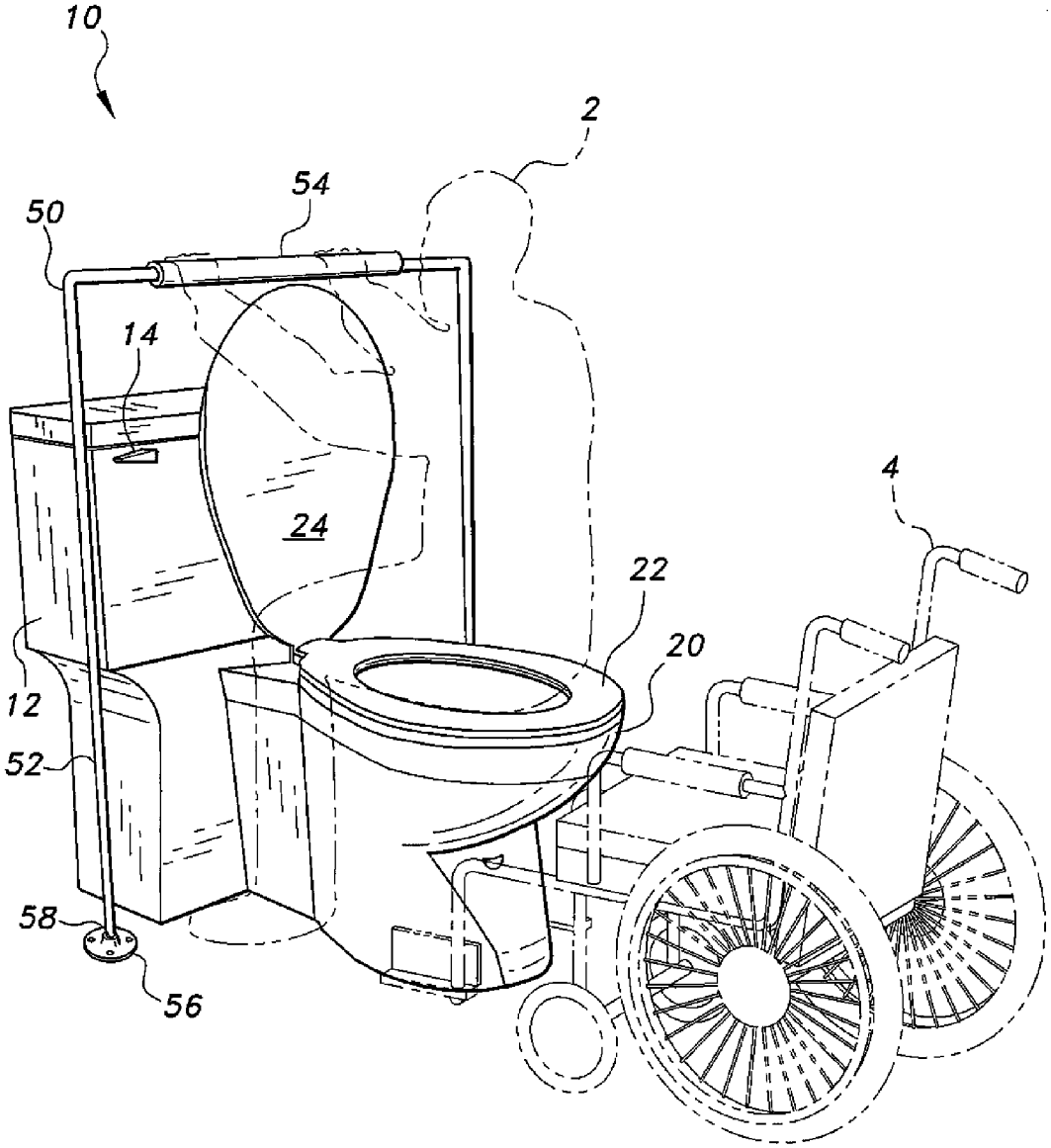
FIG. 3 is an environmental perspective view of a third embodiment of a toilet and support bar for the disabled according to the present invention, showing a user in phantom demonstrating the manner of use.

Referring to FIGS. 1-3, the toilet of the toilet and support bar includes a tank 12 having a lid. The tank 12 is a reservoir of water to be used for flushing or evacuating waste from the toilet. The tank 12 supports at least one flush handle 14. The figures illustrate a preferred arrangement of two flush handles 14 (seen most clearly in FIG. 1) positioned on opposite sides of the tank 12. The two flush handles 14 provide access for a user 2 having limited or restricted arm mobility. For example, in case the user 2 is lacking a left arm, a conventional toilet typically has a single handle positioned on the left side of the tank 12, creating difficulty for the user 2 to flush with the usable right arm. Therefore, providing a flush handle 14 on each side of the tank 12 provides greater accessibility for the disabled person, providing the option of using either flush handle 14. Alternatively, the flush handle may be a centrally mounted flush handle 14' (shown in phantom), or the toilet 10 may have an automatic flushing system in lieu of the oppositely disposed flush handles 14.

Referring to FIG. 1, the toilet for the disabled, designated generally as 10 in the drawings, is illustrated. The tank 12 sits atop a pedestal 16. Pedestal 16 provides a stable base and anchor for the toilet 10. The pedestal 16 is secured to the supporting structure, such as a floor, in a conventional manner. The pedestal 16 includes the necessary conduits to allow water to flow from the tank 12 into the toilet bowl 20, and to refill the tank 12. As seen in FIG. 3, the user 2 is able to slide forward from a wheelchair 4 onto the toilet seat 22 of the toilet bowl 20. The body of the user 2 is not rotated, nor does the user 2 have to push the wheelchair 4 away in order to have room to the exercise the functions of the body. Also, the user 2 simply slides backward from the toilet seat 22 into the wheelchair once completed. Thus, the toilet for the disabled 10 gives freedom of mobility and easier access to accomplish toilet functions.

In FIG. 1, a first embodiment of the toilet and support bar for the disabled is shown. A support bar 30, which the user 2 grasps to assist in moving to and from the wheelchair, and the maintain stability while using the toilet 10. The support bar 30 has a generally inverted U-shape configuration. As seen in FIG. 1, positioned on the floor, one opposite sides of the pedestal 16, a pair of anchors 36 having receiving orifices or sockets 38. The anchors 36 are secured to the floor in any suitable and conventional manner in order to remain in a fixed and rigid position. The ends of the inverted U-shape of the support bar 30 have angled ends 32 that matingly engage with the receiving orifices or sockets 38 of the anchors 36. The support bar 30 is preferably formed of a rigid material that provides a strong and stable handle for the user 2 to hold onto while sliding to and from the wheelchair 4. The top crossbar of the inverted U-shape support bar 30 may be provided with a resilient material or padding 34 to provide a comfortable area for the user 2 to grasp. Although the use of the resilient material or padding 34 is preferable, the use of such material or padding 34 is optional.

As long as the surface is dimensioned and configured to be graspable, the support bar 30, when the angled ends 32 are inserted into the receiving orifices or sockets 38 of the anchors 36, becomes a safety structure to assist those that are disabled to independently use the toilet 10. The legs of the support bar 30 raise the crossbar to a height that is above the tank 12 and provides sufficient clearance to raise and lower the toilet lid 24, while being at a height convenient for a wheelchair-bound user to grasp for assistance in in pulling, pushing, or steadying maneuvers that may be required to move on or off the toilet seat 22. In addition, the width of the support bar 30 is greater than that of the tank 12, so that access to the flush handles 14 (or push-to-flush button 14') is easily achieved.

The toilet bowl 20 has the toilet seat 22, and a toilet lid 24. Both the toilet seat 22 and the toilet lid 24 are each independently pivotally attached to the toilet bowl 20 by hinges. The toilet bowl 20, the toilet seat 22, and the toilet lid 24 are designed and configured in a reverse fashion from the standard western type toilets. This means that the wider portion of the toilet bowl 20 and the toilet seat 22 are forward and the narrower portions of the toilet bowl 20 and the toilet seat are closest to the pedestal 16 and tank 12, which funnels waste matter towards a forward drain. The toilet bowl floor drain and S-trap or P-trap are also forward and reversed from their conventional configuration, rather than rearward, as in a conventional toilet bowl. In other words, the toilet bowl and its internal drain plumbing are reversed 180° from a conventional toilet bowl. This allows the user 2 to access the toilet for the disabled 10 without having to maneuver about a 180° turn from a wheelchair 4.

It is noted that the resilient material or padding 34 is preferably formed from a bacterial and microbial resistant substance to reduce the possibility of contact with infectious or contagious disease carriers.

Referring to FIG. 2, a second embodiment of a toilet and support bar for the disabled is illustrated. In this embodiment, the user 2 likewise will be able to slide from the wheelchair 4 onto the toilet seat 22. The components of the toilet 10 are substantially identical in the two embodiments. The support bar 40 of the embodiment of FIG. 2 also has a generally inverted U-shape, although having straight legs, the top crossbar being covered with a resilient material or padding 44. The resilient material or padding 44 provides a comfortable area for the user 2 to grasp onto the support bar 40. Although the use of the resilient material or padding 44 is preferable, the material or padding 44 is optional. The surface is dimensioned and configured to be grasped by a user. It is noted that the resilient material or padding 44 is preferably formed from a bacterial and microbial resistant substance to reduce the possibility of contact with infectious or contagious disease carriers.

In order to attach the support bar 40 to the anchors 46, the receiving orifices or sockets 48, angled feet 42 are removably attached to the support bar 40. However, if the support bar 44 is retrofitted to an existing toilet, then this second embodiment provides a solution. The support bar 44 is shown to terminate in straight ends. Each one of the straight ends of the support bar 44 engages an angled foot coupler 42. The angled foot couplers 42 securely engage the orifices or sockets 48, respectively, thereby anchoring the support bar 44 to the anchors 46. The legs of the support bar 40 raise the crossbar 44 to a height that is above the tank 12 and provides sufficient clearance to raise and lower the toilet lid 24, while being at a height convenient for a wheelchair-bound user to grasp for assistance in in pulling, pushing, or steadying maneuvers that may be required to move on or off the toilet seat 22. In addition, the width of the support bar 40 is greater than that of the tank 12, so that access to the flush handles 14 (or push-to-flush button 14') is easily achieved.

Referring to FIG. 3, the support bar 50, as like support bar 30 of FIG. 1, and support bar 40 of FIG. 2, has a generally inverted U-shape configuration. As seen in FIG. 3, the ends of the inverted U-shape of the support bar 50 have straight end legs 52 that matingly engage with the receiving orifices or sockets 58 of the anchors 56. The top crossbar of the inverted U-shape support bar 50 may be provided with a resilient material or padding 54 to provide a comfortable area for the user 2 to grasp. Although the use of the resilient material or padding 54 is preferable, the use of such material or padding 54 is optional.

As long as the surface is dimensioned and configured to be graspable, the support bar 50, when the ends of straight legs 52 are inserted into the receiving orifices or sockets 58 of the anchors 56, becomes a safety structure to assist those that are disabled to independently use the toilet 10. The legs of the support bar 50 raise the crossbar to a height that is above the tank 12 and provides sufficient clearance to raise and lower the toilet lid 24, while being at a height convenient for a wheelchair-bound user to grasp for assistance in in pulling, pushing, or steadying maneuvers that may be required to move on or off the toilet seat 22. In addition, the width of the support bar 50 is greater than that of the tank 12, so that access to the flush handles 14 (or push-to-flush button 14') is easily achieved.

Figure 4:
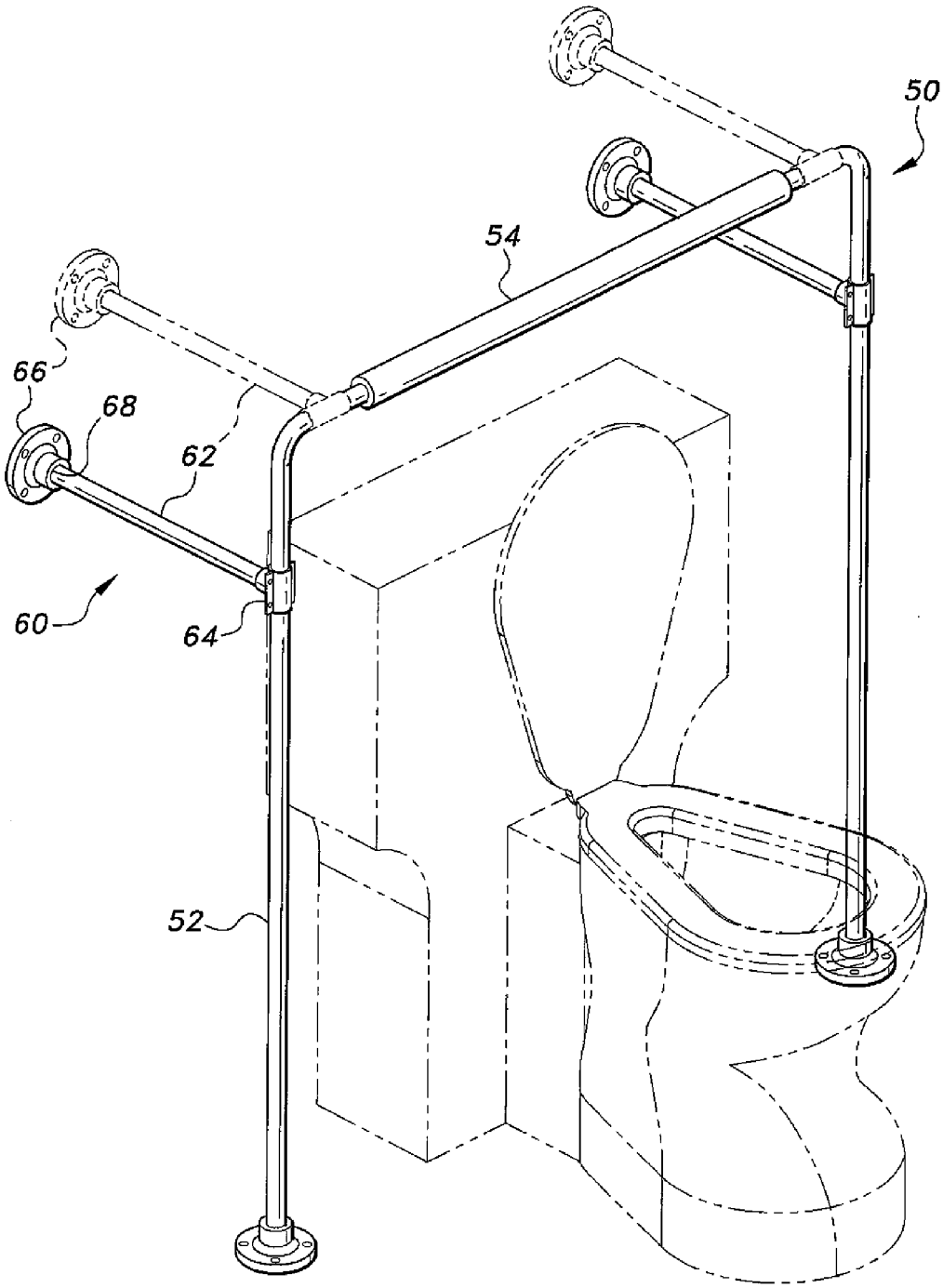
FIG. 4 is a perspective view of a support bar and stabilizer of a toilet for the disabled according to the present invention.

FIG. 4 illustrates an optional accessory for the safety of the user 2 while using the toilet 10. A plurality of stabilizers 60 are provided to maintain the rigidity of the support bar 50 (and likewise, 30 and 40 as well). Preferably, stabilizers 60 are used in pairs, and are symmetrically disposed about the support bar 50. The stabilizers 60 have a substantially rigid bar 62 having two ends. The first end, like the ends of legs 52 of the support 50, is received into orifices or sockets 68 of anchors 66. The anchors 66 are substantially identical to anchors 56; however anchors 66 are mounted to a wall structure in any suitable or conventional manner in order to provide a fixed and rigid position. The second end of bar 62 has a clamp 64 thereon. Clamp 64 is designed and configured to receive a portion of the support bar 50 therein, and holds the support bar 50 in rigid fashion, so as to increase the stability of the support bar 50 about the toilet 10.

Figure 5A:
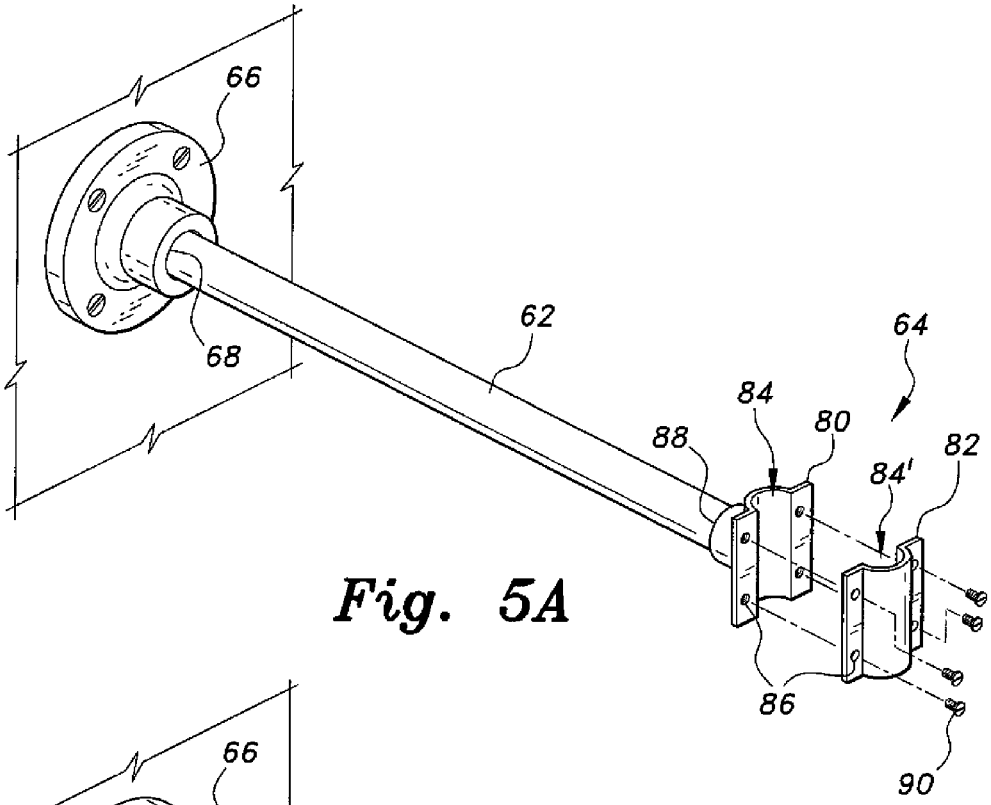
FIG. 5A is a partially exploded perspective view of a first stabilizer of FIG. 4.
Figure 5B:
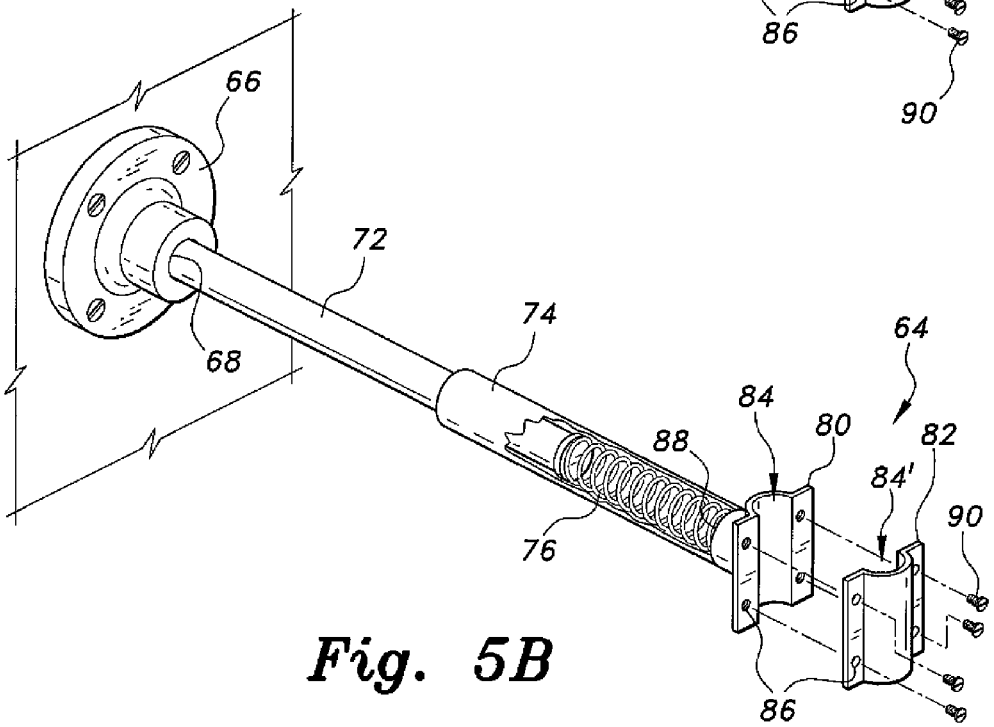
FIG. 5B is a partially exploded perspective view of a second stabilizer of FIG. 4.

FIGS. 5A and 5B illustrate two variations of the stabilizer 60. In FIG. 5A, the stabilizer 60 is formed with a rigid bar 62 of a predetermined length. In FIG. 5B, the stabilizer 60 is formed with a telescoping feature, useable to capture any anomalies in a room structure. The telescoping feature has an inner rod 72, and an outer sleeve 74. The inner rod and outer sleeve function cooperatively to establish a predetermined length for maintaining the support bar 30, 40, 50 in a rigid and stable manner. The outer sleeve 74 is secured to the inner rod 72 when the predetermined length is established and thereby locked in place. Optionally, a biasing member 76, shown as a spring, is located within the outer sleeve 74. The biasing member 76 allows the stabilizer 60 to conform to a predetermined length, and yet give leeway or tolerance variations in stabilizing the support bar 30, 40, 50.

The clamp 64 is also further illustrated in FIGS. 5A and 5B, clamp 64 is fixed to the end of rigid bar 62 or outer sleeve 74 via attachment 88. Clamp 64 has a clamp end 80 coupled to attachment 88. Clamp end 80 has a groove 84, shown having a semi-circular form but it is understood that the groove 84 is semi-circumferential, so as to conform to the circumferential shape of support bar 30, 40, 50 whether round or parallelepiped. In addition, clamp end 84 has outwardly extending edges supporting a plurality of holes 86. The clamp 64 also has an end cover 82 that is a mirror image of clamp end 80. In that end cover 82 has a semi-circumferential groove 84' and outwardly extending edges also supporting a plurality of holes 86. When clamp end 80 and end cover 82 are coupled together around a portion of support bar 30, 40, 50, a plurality of fasteners secured the clamp 64 via the aligned plurality of holes 86.

Figure 5C:
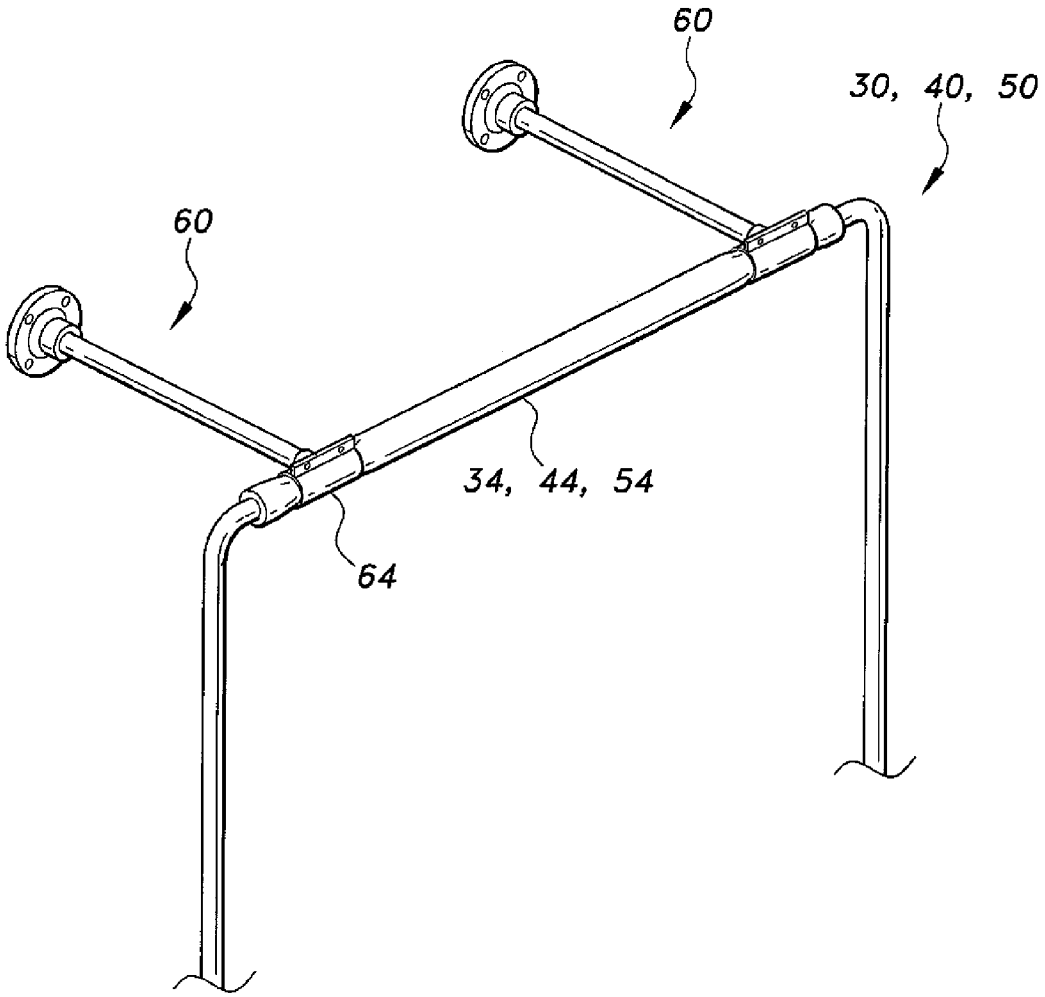
FIG. 5C is another perspective view of the stabilizer of FIG. 4.

FIG. 5C illustrates an alternate arrangement for the stabilizers 60 when used with the support bar 30, 40, 50. The stabilizers 60 can also be attached so as to circumferentially capture a portion of the support bar 30, 40, 50 and the padding 34, 44, 54, respectively. In this fashion, the support bar 30, 40, 50 and respective padding 34, 44, 54 are held so that the support bar 30, 40, 50 is stabilized to support the user 2, as well as maintaining the padding 34, 44, 54 in a fixed position on the crossbar of support bar 30, 40, 50. Thus preventing any slippage of the padding 34, 44, 54 about, along, or around the support bar 30, 40, 50.

It is to be understood that the present invention is not limited to the embodiments described above, but encompasses any and all embodiments within the scope of the following claims.

I claim:

1. A toilet for the disabled, comprising:

a pedestal adapted for mounting on a floor;

a toilet tank mounted on the pedestal;

a toilet bowl connected to the pedestal and the toilet tank, the tank defining a water reservoir for flushing and refilling the toilet bowl, the toilet bowl having a seat pivotally attached thereto, the bowl and the seat having a narrow portion adjacent the pedestal and tank and a wider portion extending forward from the narrow portion, whereby the bowl and the seat are adapted for use by a user sitting on the seat facing the tank;

a plurality of anchors; and a support member having a pair of parallel legs and a crossbar handle defining an inverted U-shaped configuration, the legs being attached to the floor on opposite sides of the pedestal with at least two of the plurality of anchors, the legs extending vertically, the handle being raised to a height above the tank and extending for a width greater than the tank, whereby the handle may be grasped with both hands by a disabled user and used to support the user while moving forward onto the toilet seat.

2. The toilet according to claim 1, wherein:

each one the plurality of anchors has a mounting socket formed therein; and the legs of the support member have angled lower ends, the angled lower ends being secured in the sockets to attach the support member to the anchor.

3. The toilet according to claim 1, wherein:

each one the plurality of anchors has a mounting socket formed therein; and the legs of the support member have lower ends, the lower ends being secured in the sockets to attach the support member to the anchor.

4. The toilet according to claim 1, further comprising:

each one the plurality of anchors has a mounting socket formed therein; and a pair of angled couplers connecting the lower ends of the legs of the support members to the sockets, the couplers being secured in the sockets to attach the support member to the anchor.

5. The toilet according to claim 1, further comprising a resilient grip disposed on the crossbar handle.

6. The toilet according to claim 1, further comprising a pair of flush handles mounted on opposite sides of the tank, the flush handles being independently operable to release water from the tank reservoir to flush the toilet bowl.

7. The toilet according to claim 1, further comprising a push-to-flush button centrally mounted on top of the tank, the push-to-flush button operable to release water from the tank reservoir to flush the toilet bowl.

8. A toilet for the disabled, comprising:

a pedestal adapted for mounting on a floor;

a toilet tank mounted on the pedestal;

a toilet bowl connected to the pedestal and the toilet tank, the tank defining a water reservoir for flushing and refilling the toilet bowl, the toilet bowl having a seat pivotally attached thereto, the bowl and the seat having a narrow portion adjacent the pedestal and tank and a wider portion extending forward from the narrow portion, whereby the bowl and the seat are adapted for use by a user sitting on the seat facing the tank;

a plurality of anchors;

a support member having a pair of parallel legs and a crossbar handle defining an inverted U-shaped configuration, the legs being attached to the floor on opposite sides of the pedestal with at least two of the plurality of anchors, the legs extending vertically, the handle being raised to a height above the tank and extending for a width greater than the tank, whereby the handle may be grasped with both hands by a disabled user and used to support the user while moving forward onto the toilet seat; and at least two stabilizers attached to the support member for preventing motion of the support member when grasped by a user, each of the at least two stabilizers having a first and second end;

wherein said stabilizers being symmetrically disposed about the support member.

9. The toilet according to claim 8, wherein:

each one the plurality of anchors has a mounting socket formed therein; and each stabilizer is attached at the first end to the mounting socket of a respective anchor;

wherein the each respective anchor of each stabilizer being attached to a wall structure.

10. The toilet according to claim 9, further comprising:

a clamp having a clamp end, an end cover, and a plurality of fasteners;

the clamp end being secured to the second end of each stabilizer, the clamp end having a first semi-circumferential trough for receiving a portion of the support member therein;

the end cover having a second semi-circumferential groove for receiving the portion of the support member;

wherein the first and second semi-circumferential grooves substantially surround the portion of the support member;

the fasteners couple the end cover to the clamp end, securing the portion of the support member therebetween.

11. The toilet according to claim 10, wherein the stabilizer is a unitary rod.

12. The toilet according to claim 10, wherein the stabilizer is a telescoping rod having an inner rod, and a sleeve slidably coupled to the inner rod.

13. The toilet according to claim 12, wherein the telescoping rod has a resiliently biasing element disposed internally of the sleeve.

14. The toilet according to claim 8, further comprising a resilient grip disposed on the crossbar handle.

15. The toilet according to claim 14, wherein the at least two stabilizers are attached to the support member near the ends of the resilient grip.

* * * * *